US008405057B1

(12) United States Patent
Kinstler

(10) Patent No.: US 8,405,057 B1
(45) **Date of Patent: *Mar. 26, 2013**

(54) RADIATION SHIELD DEVICE WITH EMBEDDED CRYOGEN STORAGE AND ASSOCIATED METHOD

(75) Inventor: Gary A. Kinstler, Torrance, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/092,320

(22) Filed: Apr. 22, 2011

(51) Int. Cl.
*G21F 3/00* (2006.01)
*F25B 19/00* (2006.01)

(52) U.S. Cl. ..... 250/515.1; 250/505.1; 244/171.7

(58) Field of Classification Search ..... 250/505.1, 250/515.1; 244/171.7, 171.8
See application file for complete search history.

(56) References Cited

U.S. PATENT DOCUMENTS

| | | | | |
|---|---|---|---|---|
| 4,058,945 | A | 11/1977 | Knapp | |
| 4,291,541 | A * | 9/1981 | Kneip et al. | 62/51.1 |
| 5,012,217 | A * | 4/1991 | Palkovich et al. | 335/301 |
| 5,317,879 | A * | 6/1994 | Goldberg et al. | 62/51.1 |
| 5,379,600 | A * | 1/1995 | Moritsu et al. | 62/47.1 |
| 7,464,901 | B2 * | 12/2008 | Kinstler | 244/171.7 |
| 7,484,691 | B2 * | 2/2009 | Kinstler | 244/171.7 |
| 7,990,662 | B2 * | 8/2011 | Berkley et al. | 361/19 |
| 8,054,077 | B2 * | 11/2011 | Hsieh et al. | 324/307 |
| 8,210,481 | B2 * | 7/2012 | Kinstler | 244/171.7 |
| 2006/0169931 | A1 * | 8/2006 | Kinstler | 250/515.1 |
| 2008/0307801 | A1 * | 12/2008 | Tanaka et al. | 62/51.1 |
| 2009/0038318 | A1 * | 2/2009 | Begg et al. | 62/47.1 |
| 2010/0323900 | A1 * | 12/2010 | Kawashima | 505/211 |

OTHER PUBLICATIONS

Hoffman, J. et al., "Use of Superconducting Magnet Technology for Astronaut Radiation Protection" presented Jun. 13-14, 2005 at the MIT-NASA Radiation Shielding Workshop, Cambridge, MA.*

Hoffman, J., et al.; "Use of Superconducting Magnet Technology for Astronaut Radiation Protection"; NIAC Phase I Fellows Meeting; Atlanta, Georgia; Mar. 15-16, 2005.

Technovelgy.com; "Superconducting Magnetic Bubble to Protect Astronauts from Radiation"; downloaded from http://www.technovelgy.com/ct/Science-Fiction/News.asp?NewsNum=289 on Nov. 2, 2010; 3 pages.

Augustynowicz, S.D., et al.; "Cryogenic Insulation System for Soft Vacuum"; 1999; 8 pages.

* cited by examiner

*Primary Examiner* — David A Vanore
*Assistant Examiner* — Wyatt Stoffa
(74) *Attorney, Agent, or Firm* — Alston & Bird LLP

(57) ABSTRACT

A cryogenically cooled radiation shield device as well as an associated method are provided in order to shield an area, such as a space vehicle capsule, from radiation. The radiation shield device may have embedded cryogen storage. The radiation shield device may include inner and outer coil shells that extend about the area to be shielded. Each coil shell includes coils formed of a superconductive material and disposed within respective first conduits. The radiation shield device may also include a first storage tank configured to store a first cryogen liquid and disposed in fluid communication with the first conduits. The first storage tank is disposed between the inner and outer coil shells. The radiation shield device may further include a second conduit at least partially surrounding the inner and outer coil shells that is at least partially filled with a second cryogen liquid, different than the first cryogen liquid.

19 Claims, 4 Drawing Sheets

RADIATION SHIELD DEVICE WITH EMBEDDED CRYOGEN STORAGE AND ASSOCIATED METHOD

TECHNOLOGICAL FIELD

Embodiments of the present disclosure relate generally to methods and devices for shielding an area from radiation and, more particularly, to a cryogenically cooled radiation shield device and an associated method.

BACKGROUND

The sun occasionally releases significant amounts of charged particles during events known as coronal mass ejectas ("CMEs"). The charged particles released during CMEs include electrons, protons, and heavy ions. Each CME may last for about one or two days in the vicinity of earth, but their effects may linger for up to a week. Such proton and heavy ion radiation can cause cell damage to humans exposed to such radiation. Additionally, sensitive electronic components and other devices may be adversely affected by such radiation. Therefore, even though CMEs are relatively uncommon occurrences, the amounts of radiation they could potentially inflict upon a crew and equipment of a spacecraft suggests that consideration be given to shielding part or all of a spacecraft from such radiation. Similarly, comparable radiation protection may be desirable in other environments as well, such as habitats for celestial bodies such as the moon and Mars.

Shielding from proton and heavy ion radiation may generally be accomplished by either absorbing the particles or by deflecting the particles. To absorb the radiation, materials of a thickness sufficient for the amount of energy expected from the radiation, can be provided around an area that houses the crew and/or sensitive equipment during a CME. However, because of the significant amount of weight such a housing would require, the use of radiation absorbing material is not practical for space exploration and other applications. Additionally, the absorption of high energy particles may release a different form of radiation such as gamma rays and X-rays that pass through the shielding material and create other difficulties for the crew and/or equipment.

It may therefore be preferable to deflect the particles of radiation rather than absorb them. In order to deflect particles of radiation, active radiation shield devices have been proposed. An active radiation shield device may include one or more coils that extend about an area to be shielded, such as about a spacecraft or the like. By passing current through the coil(s) of the radiation shield device, a magnetic field may be generated that deflects particles of radiation that may otherwise impinge upon the spacecraft.

In order to facilitate the generation of the protective magnetic field, a radiation shield device may include coils formed of a superconductive material. During operation, the coils formed of the superconductive material must therefore be maintained at a temperature below its critical superconducting temperature onset level and as close to absolute zero as practical. As such, the coils formed of a superconductive material may be cooled to a temperature below its critical superconducting temperature onset level by electrical refrigeration units. However, the electrical refrigeration units may be relatively heavy and may consume a substantial amount of electrical power. In addition, the electrical refrigeration unit may require electrical power generation and distribution, which also disadvantageously adds to the overall weight of the system.

As it is often desirable to reduce the weight of a spacecraft, it may therefore be undesirable to include an electrical refrigeration unit and the associated electrical power generation distribution system in order to cool the coils formed of a superconducting material to a temperature near absolute zero. As such, radiation shield devices, including coils formed of a superconductive material, may alternatively immerse the coils in liquid helium, which lowers the temperature of the coils from an ambient temperature, such as about 23° C., to a temperature required for superconducting operations, such as −269° C., as a result of the boil-off vaporization of the liquid helium. Since the latent heat of the liquid helium is relatively low, however, an excessive amount of liquid helium, as measured in terms of the weight and volume of the liquid helium, may need to be boiled off in order to cool the coils. As such, a substantial quantity of liquid helium may be required to be provided in order to sufficiently cool the coils formed of a superconductive material, thereby disadvantageously increasing the weight of the spacecraft or the like. Additionally, the liquid helium must be stored onboard the spacecraft and may consume a portion of the interior volume of the spacecraft that could otherwise be utilized for other purposes, such as for the crew and/or instrumentation.

In order to conserve power in an instance in which the cooling of the superconductive coils is provided by an electrical refrigeration unit or to limit the boil off of liquid helium in an instance in which the cooling of the superconductive coils is provided by liquid helium, the superconductive coils may not be maintained at the temperature required for superconducting operations, such as −269° C., at all times throughout the mission. Instead, the superconductive coils may be maintained at a nominal temperature that is greater than that required for superconductive operations. The spacecraft may be configured, however, to detect a CME or the approach of other high energy particles and, once detected, may be further configured to initiate cooling of the superconductive coils, such as by an electrical refrigeration unit or liquid helium, so as to bring the coils to a temperature required for superconducting operations prior to exposure to the CME or other high energy particles. However, this approach by which the superconductive coils are in a state of readiness during only selected time periods, such as only in response to the detection of a CME or other high energy particles, may limit overall mission availability and reliability.

BRIEF SUMMARY

A cryogenically cooled radiation shield device as well as an associated method are provided according to embodiments of the present disclosure in order to shield an area, such as the capsule of a space vehicle, from radiation, such as the charged particles released during CMEs. In this regard, the cryogenically cooled radiation shield device and associated method of one embodiment are configured that may be maintained in a state of readiness throughout an entire mission while storing the cryogen liquid outside of the area to be shielded from radiation, such as the crew habitable interior volume.

In one embodiment, a radiation shield device is provided that has embedded cryogen storage. The radiation shield device of this embodiment includes at least two coil shells comprised of a superconductive material and disposed within respective first conduits filled with a first cryogen liquid. The at least two coil shells may extend about an area to be shielded from radiation. The radiation shield device of this embodiment also includes at least one storage shell defining a second conduit filled with a second cryogen liquid that is different than the first cryogen liquid. The at least one storage shell may be disposed about an exterior of the at least two coil shells. In this embodiment, the radiation shield device also includes thermal insulation surrounding the first conduits and positioned between the first conduits and the at least one second conduit. The thermal insulation may couple the second conduit and the at least two coil shells.

The thermal insulation of one embodiment is provided between the first conduits filled with the first cryogen liquid and the second conduit filled with the second cryogen liquid. The radiation shield device of one embodiment may also include a first storage tank configured to store the first cryogen liquid and disposed in fluid communication with the first conduits. The first storage tank may be disposed, for example, between the at least two coil shells. The radiation shield device of one embodiment may also include a second storage tank configured to store the second cryogen liquid and disposed in fluid communication with the at least one storage shell. The second storage tank may also be disposed between the at least two coil shells. Further, the radiation shield device may include thermal insulation surrounding the second conduit and positioned between the second conduit filled with the second cryogen liquid and an external ambient thermal environment.

In another embodiment, a radiation shield device is provided that includes inner and outer coil shells that extend about an area to be shielded from radiation. Each coil shell includes coils formed of a superconductive material and disposed within respective first conduits. The radiation shield device of this embodiment also includes a first storage tank configured to store a first cryogen liquid and disposed in fluid communication with the first conduits. The first storage tank is disposed between the inner and outer coil shells. The radiation shield device of this embodiment further includes a second conduit at least partially surrounding the inner and outer coil shells. The second conduit is configured to be at least partially filled with a second cryogen liquid, different than the first cryogen liquid. In this embodiment, the radiation shield device also includes thermal insulation disposed between the first and second conduits.

A radiation shield device of one embodiment also includes a second storage tank configured to store the second cryogen liquid and disposed in fluid communication with the second conduit. The second storage tank may be disposed between the inner and outer coil shells. In one embodiment, the radiation shield device also includes thermal insulation surrounding the first storage tank and/or thermal insulation surrounding the second conduit and positioned between the second conduit filled with the second cryogen liquid and an external ambient thermal environment. The thermal insulation disposed between the first and second conduits may surround both the inner and outer coil shells. Likewise, the second conduit may surround both the inner and outer coil shells.

In a further embodiment, a method of cryogenically cooling a radiation shield device is provided that includes at least partially immersing coils of inner and outer coil shells within a first cryogen liquid. The coils of the inner and outer coil shells are formed of a superconductive material and extend about an area to be shielded from radiation. The method of this embodiment also includes storing at least some of the first cryogen liquid in a first storage tank which may be surrounded, for example, with thermal insulation. The first storage tank is disposed between the inner and outer coil shells and is in fluid communication with the inner and outer coil shells. In this embodiment, the method also at least partially fills a second conduit with a second cryogen liquid that is different than the first cryogen liquid. The second conduit at least partially surrounds the inner and outer coil shells and is separated from the inner and outer coil shells by thermal insulation disposed therebetween. In one embodiment, the second conduit is surrounded with thermal insulation.

In one method, at least partially immersing the inner and outer coil shells includes at least partially filling respective first conduits in which the inner and outer coil shells are disposed with the first cryogen liquid. The method of one embodiment also includes storing at least some of the second cryogen liquid in a second storage tank that is in fluid communication with the second conduit. In this regard, at least some of the second cryogen liquid may be stored in a second storage tank that is disposed between the inner and outer coil shells.

In accordance with embodiments of the present disclosure, a cryogenically cooled radiation shield device and an associated method are provided in order to deflect particles of radiation in a manner that may be maintained in a state of readiness throughout an entire mission, such as by maintaining the coils at a reduced temperature that is at or relatively close to the critical superconducting temperature onset level throughout the entire mission. However, the features, functions and advantages that have been discussed may be achieved independently and the various embodiments of the present disclosure may be combined in the other embodiments, further details of which may be seen with reference to the detailed description and drawings.

BRIEF DESCRIPTION OF THE DRAWINGS

Figure 1:
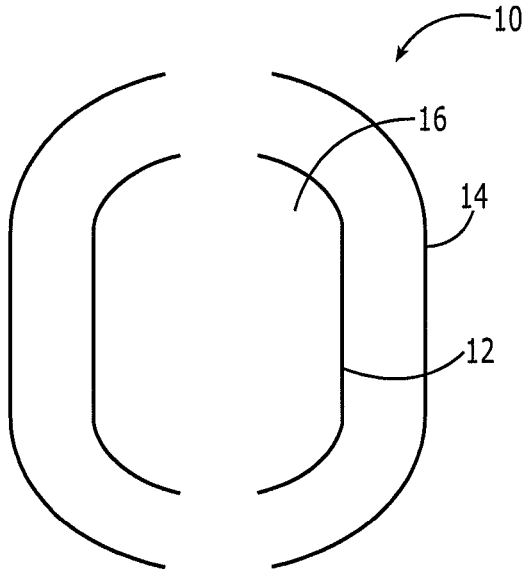
Figure 2:
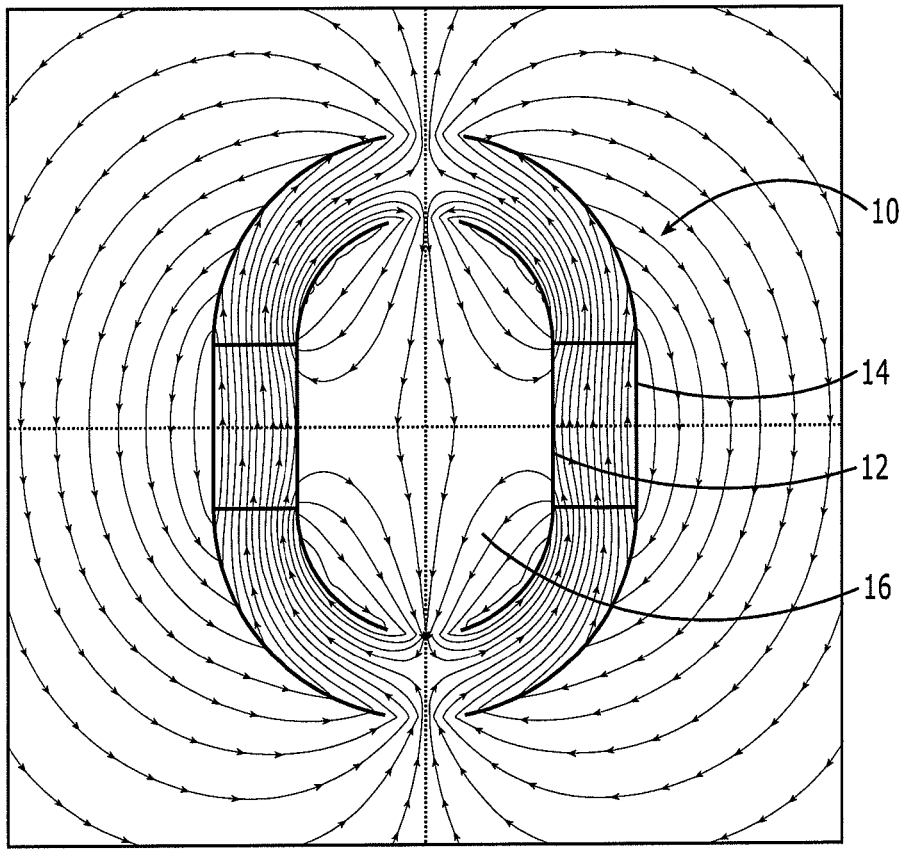
Figure 3:
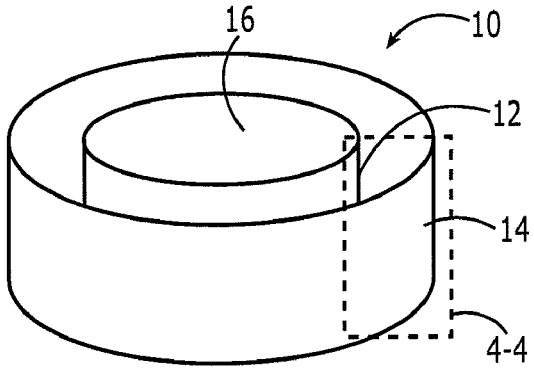
Figure 4:
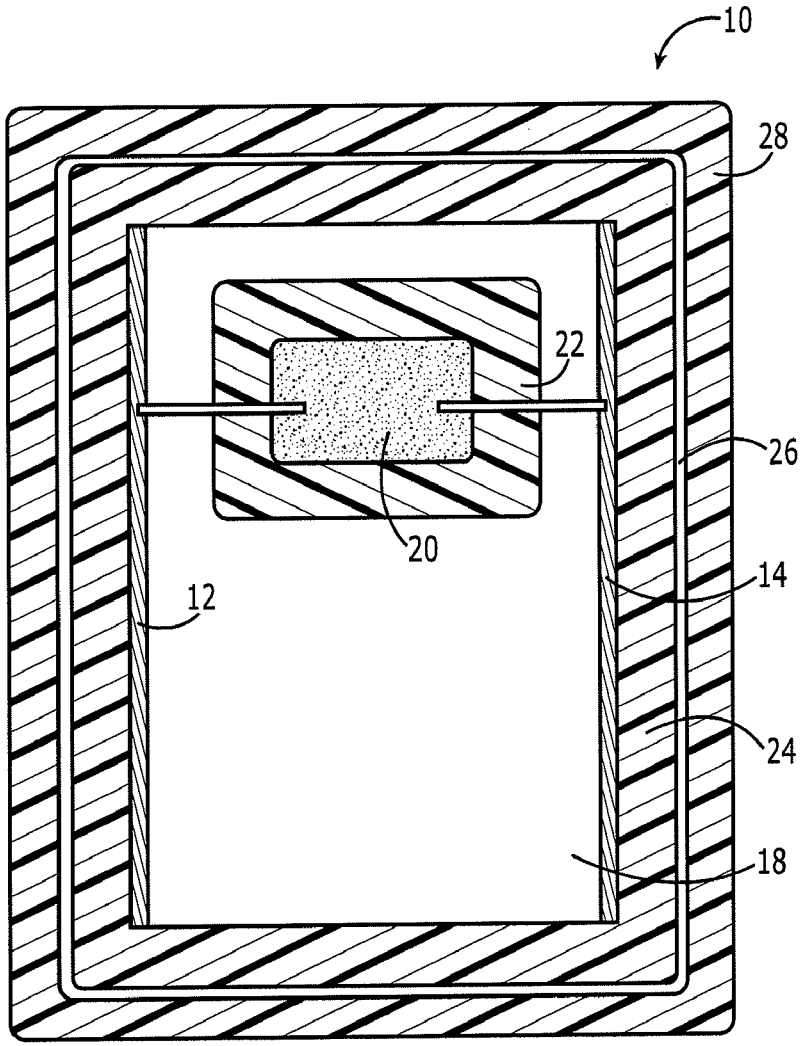
Figure 5:
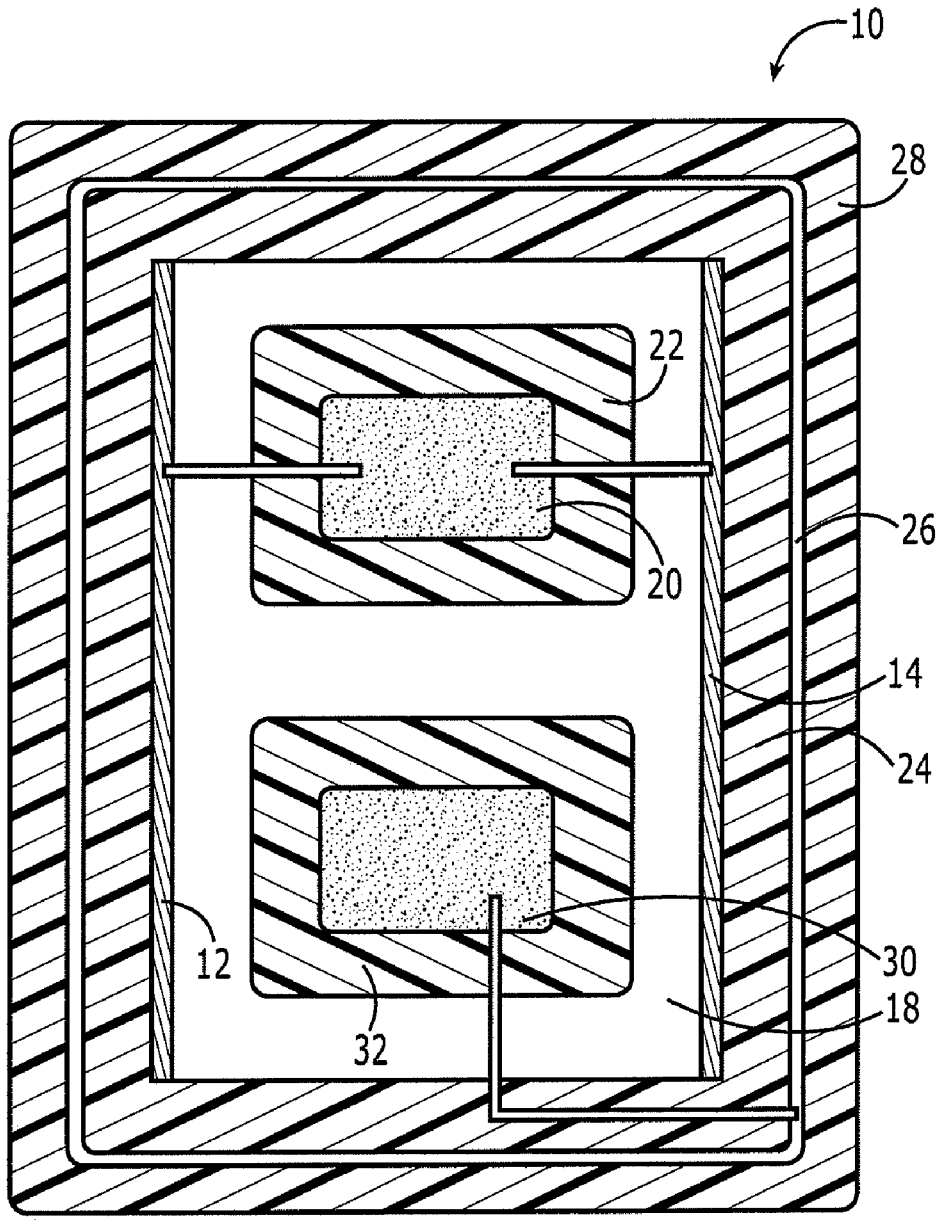
Figure 6:
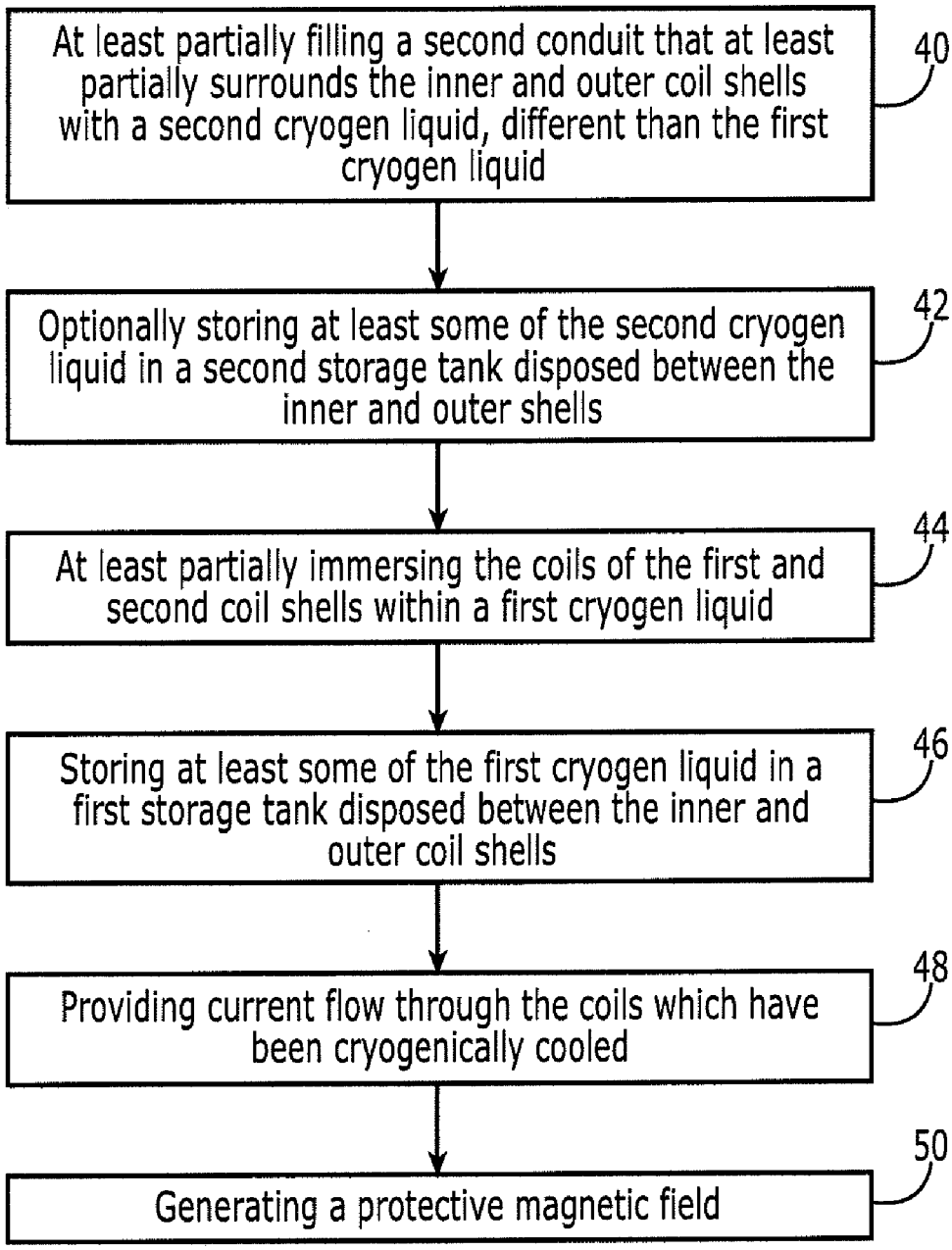

Having thus described embodiments of the disclosure in general terms, reference will now be made to the accompanying drawings, which are not necessarily drawn to scale, and wherein:

FIG. 1 is a simplified cross-sectional view of the first and second shells of a radiation shield device in accordance with one embodiment of the present disclosure FIG. 2 illustrates the magnetic flux lines generated by the first and second shells of the radiation shield device of FIG. 1;

FIG. 3 is a simplified perspective view of a portion of the first and second shells of the radiation shield device of FIG. 1;

FIG. 4 is a cross-sectional view of section 4-4 of the radiation shield device of FIG. 3;

FIG. 5 is a cross-sectional view of section 4-4 of the radiation shield device of FIG. 3 in which a second storage tank for storing a second cryogen liquid has been added in accordance with another embodiment of the present disclosure; and FIG. 6 is a block diagram of the operations performed in accordance with a method of cryogenically cooling a radiation shield device in accordance with one embodiment of the present disclosure.

DETAILED DESCRIPTION

Embodiments of the present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, the radiation shield device 10 in accordance with one embodiment of the present disclosure is illustrated. The radiation shield device 10 is generally described herein as providing protection from radiation for a manned space vehicle or a habitat for celestial bodies, particularly during CME events. However, further embodiments of the present disclosure may include radiation shield devices for any situation in which protection from particle radiation is desired beyond the earth's magnetosphere.

The radiation shield device 10 of the illustrated embodiment includes first and second coil shells 12, 14 that at least partially surround an area 16 to be shielded from radiation. In the illustrated embodiment, a space vehicle defines the area 16 to be shielded from radiation. A space vehicle may have various configurations, but the space vehicle of the illustrated embodiment has a cylindrical center portion and tapered or rounded end portions. A space vehicle may house one or more crew members as well as equipment, such as electronics, that may be sensitive to particle radiation. As shown in the illustrated embodiment, the first and second coil shells 12, 14 at least partially surround the space vehicle. As such, the first and second coil shells may somewhat follow the shape of the space vehicle. In this regard, the first and second coil shells 12, 14 of the illustrated embodiment have a medial cylindrical portion that encircles the cylindrical central portion of the space vehicle and opposed end portions that are rounded radially inward from the medial cylindrical portion so as to generally follow the rounded end portions of the space vehicle. The end portions of the first and second coil shells 12, 14 may approach one another in a curved fashion as shown in the embodiment of FIG. 1. Alternatively, the end portions of the first and second coil shells 12, 14 may approach one another in a linear or other fashion so as to more closely follow or conform to end portions of the space vehicle that are similarly shaped. The separation distance between the first and second coil shells generally remains the same regardless of the overall shape of the radiation shield device.

As shown in FIG. 1, the second coil shell 14 is spaced apart from the first coil shell 12 in such a manner that the second coil shell is further away from the area 16 to be shielded, such as the space vehicle, than the first coil shell. In this regard, the first coil shell 12 may be adjacent to the area 16 to be shielded and, in one embodiment, is attached or connected thereto, while the second coil shell 14 is spaced further from the area to be protected. As such, the radiation shield device 10 may include a truss network between the first and second coil shells 12, 14 for connecting the second coil shell to the first coil shell and positioning the second coil shell relative to the first coil shell. In one embodiment, the truss network 18 is formed of a plurality of truss members extending between and connected to the first and second coil shells 12, 14. Although the truss network 18 may be formed of various materials, the truss elements of one embodiment may be formed of a composite material, such as a carbon reinforced matrix material in order to provide sufficient strength while limiting the weight of the truss network.

The second coil shell 14 may be larger than the first coil shell 12 as a result of the second coil shell being spaced further from the area 16 to be shielded and having, for example, a larger effective radius from the central axis of the area to be shielded. However, the second coil shell 14 of one embodiment has the same or a comparable shape to that of the first coil shell 12, as shown in FIG. 1.

The first coil shell 12 includes a plurality of conductive coils that encircle the area 16 to be shielded. Likewise, the second coil shell 14 includes a plurality of conductive coils that encircle the area 16 to be shielded from radiation as well as encircling the first coil shell 12.

The coils of one embodiment are formed of superconductive material. For example, the coils may be formed of a niobium titanium (NbTi) copper matrix multifilament superconducting wire winding. However, other embodiments of the present disclosure may include coils formed of alternative superconductive materials. In order to have superconductive properties, the superconductive material must be maintained at a temperature below its critical superconducting temperature onset level and as close to absolute zero as practical, preferably 36 K or lower, more preferably less than 25 K and most preferably less than 10 K. As such, the radiation shield device 10 may include a thermal control system in thermal communication with the superconductive material of the coils to lower the temperature of the superconductive material to a desired temperature below its critical superconducting temperature onset level.

In operation, current is flowed through the coils of the first coil shell 12 in one direction, such as a counterclockwise direction when looking down on the area 16 to be shielded from above. Conversely, current is flowed through the coils of the second coil shell 14 in the opposite direction, such as in a clockwise direction when viewed down on the area 16 to be shielded from above. As a result of the current flow through the coils, a magnetic field is generated by each of the first and second coil shells 12, 14 which function as first and second solenoids, respectively. As a result of the current flowing through the first and second coil shells 12, 14 being in opposite directions, however, the north and south poles of the coils of the first coil shell are correspondingly oriented opposite the north and south poles of the coils of the second coil shell. With reference to the illustrated embodiment, for example, the north pole of the coils of the first coil shell 12 may be at the upper end of the area 16 to be shielded and the south pole of the coils of the first coil shell may be at the lower end of the area to be shielded, while the north pole of the coils of the second coil shell 14 may be at the lower end of the area to be shielded and the south pole of the coils of the second coil shell may be at the upper end of the area to be shielded.

Representative magnetic flux lines generated by the first and second coil shells 12, 14 are shown in FIG. 2. As a result of the opposite direction of the current flow through the coils of the first and second coil shells 12, 14, the magnetic fields generated by the current flow through the coils of the first and second coil shells offset one another within the area 16 to be shielded such that little or no magnetic field is generated therewithin. Thus, the radiation shield device 10 need not include an internal magnetic shield device to protect the interior of the area to be shielded from the magnetic fields generated by the radiation shield device itself. Accordingly, the weight of a space vehicle or the like may be reduced relative to space vehicles that require such an internal magnetic shield device.

In the region between the first and second coil shells 12, 14, the magnetic fields generated by the current flowing in opposite directions through the coils are directed in the same direction and are additive, thereby resulting in a stronger magnetic field between the first and second coil shells than that generated by either the first or the second coil shell individually. Further details regarding the first and second coil shells of the radiation shield device 10 and the resulting magnetic field are provided by U.S. patent application Ser. No. 12/966,315 entitled "Radiation Shield Device and Associated Method", filed Dec. 13, 2010, and U.S. patent application Ser. No. 12/966,350 entitled "Cryogenically Cooled Radiation Shield Device and Associated Method", filed Dec. 13, 2010, the entire contents of both of which are incorporated by reference herein.

Referring now to FIG. 3, a portion of the radiation shield device 10 is illustrated. For example, an intermediate or central portion of the generally cylindrical section of inner and outer coil shells 12, 14 is shown in FIG. 3. As described above, the inner and outer coil shells 12, 14 may extend about an area 16 to be shielded from radiation, such as a crew compartment. In order to illustrate the manner in which the inner and outer coil shells 12, 14 are cryogenically cooled, a cross-section through the inner and outer coil shells is designated 4-4 in FIG. 3 and is shown in more detail in FIG. 4.

As shown in FIG. 4, each coil shell 12, 14 may include a respective first conduit in which the plurality of coils are disposed. While the inner and outer coil shells are shown in a cross-section in FIG. 4, the inner and outer coil shells and, therefore, the first conduits and the coils disposed therein may have a cylindrical or other closed-form shape which at least partially surround the area 16 to be shielded as generally shown in FIGS. 1-3. With reference to FIG. 4, the coils are shown by the plurality of dots, while the respective first conduits are represented by the inner and outer vertical lines on either side of the coils. The first conduit may be formed of various materials, but, in one embodiment, is formed of a material that does not react with the cryogen liquid, such as aluminum.

In order to at least partially insulate the inner and outer coil shells 12, 14, the radiation shield device 10 may include a first layer 24 of thermal insulation that extends about the inner and outer coil shells. As shown in FIG. 4, the first layer 24 of insulation may be positioned proximate the interior of the inner coil shell 12 and proximate to the exterior of the outer coil shell 14 with interior and exterior being relative to the area 16 to be protected. In the embodiment shown in FIG. 4, the first layer 24 of thermal insulation may extend continuously about each of the inner and outer coil shells 12, 14 with the thermal insulation extending between opposed ends of the inner and outer coil shells. By extending continuously about the inner and outer coil shells 12, 14, the first layer 24 of thermal insulation provides additional thermal protection to the inner and outer coil shells by further limiting exposure of the inner and outer coil shells to the external environment. Although shown for purposes of example to be cylindrical in FIGS. 3 and 4, the inner and outer coil shells 12, 14 may be larger and may have other shapes, such as those shown in FIGS. 1 and 2. As such, the first layer 24 of thermal insulation may similarly have other shapes and sizes. In any event, the first layer 24 of thermal insulation may extend along the interior of the inner coil cell 12 and along the exterior of the outer coil shell 14 and, in one embodiment, may also extend therebetween at opposed ends of the inner and outer coil shells so as to extend continuously about the inner and outer coil shells. By surrounding the inner and outer coil shells 12, 14 with the first layer 24 of thermal insulation, a space or void 18 may be defined between the inner and outer coil shells that is bordered by a combination of the inner and outer coil shells and the first layer of thermal insulation. Although the first layer 24 of thermal insulation may be formed of various materials, the first layer of thermal insulation of one embodiment is formed of a layered composite insulation with paper.

In order to cool the coils of the inner and outer coil shells 12, 14, a first cryogenic liquid may at least partially fill the respective first conduits of the inner and outer coil shells. As such, the coils of the inner and outer coil shells 12, 14 are at least partially and, in one embodiment, fully immersed in the first cryogenic liquid. For example, the coils may be configured such that the first cryogenic liquid flows through the coils. The first cryogenic liquid has a boiling point that is at least as low as the critical superconducting temperature onset level of the superconductive coils of the inner and outer coil shells 12, 14, such as −269° C. In the illustrated embodiment, the radiation shield device 10 may include a first storage tank 20 for storing the first cryogenic liquid, such as the liquid helium. Additionally, the first storage tank 20 containing the first cryogenic liquid, such as liquid helium, may be in fluid communication with the inner and outer coil shells 12, 14 and, more particularly, with the respective first conduits of the inner and outer coil shells. As such, the first liquid coolant may be supplied from the first storage tank 20 to the respective first conduits in order to immerse the windings of the inner and outer coil shells 12, 14 with the first cryogenic liquid. While the radiation shield device could include a pump or other device for moving the first cryogenic liquid from the first storage tank to the first conduits, the radiation shield device may be configured such that the first cryogenic liquid self-disperses or self-dissipates from the first storage tank throughout the first conduits in a 0 G (gravitational force) environment without the assistance of a pump or other device. Additionally, the radiation shield device may be configured such that while the space vehicle is on the ground, the first cryogenic liquid flows from the first storage tank to the first conduits as a result of a gravity feed.

In operation, the respective first conduits of the inner and outer coil shells 12, 14 may be initially filled with the first cryogenic liquid and additional amounts of the first cryogenic liquid, such as liquid helium, may thereafter be provided from the first storage tank 20 to the respective first conduits to replace any of the first cryogenic liquid that boils off. As shown in FIG. 4, the radiation shield device 10 of one embodiment may also include thermal insulation 22 that surrounds the first storage tank 20, further thermally insulating the first cryogenic liquid. The thermal insulation 22 that surrounds the first storage tank 20 may be the same as or different than the first layer 24 of thermal insulation described above. Although the thermal insulation 22 may be formed of various materials, the thermal insulation of one embodiment is formed of a layered composite insulation with paper.

In order to provide further thermal protection to the inner and outer coil shells 12, 14, the radiation shield device 10 of one embodiment may include a second shell that defines a second conduit 26 that is at least partially filled with a second cryogenic liquid, different than the first cryogenic liquid. In this regard, the second cryogenic liquid may have a slightly higher boiling point, but may also have a greater latent heat so as absorb substantially more heat more efficiently and more rapidly than the first cryogenic liquid on a per unit basis. While various cryogenic liquids may be employed such as liquid oxygen or liquid nitrogen, the second cryogenic liquid of one embodiment is liquid hydrogen having a boiling point of −253° C. and a latent heat of 455 kJ/kg-K relative to a latent heat of the liquid helium of 21 kJ/kg-K. The second conduit 26 may also be formed of various materials, but, in one embodiment, is formed of a material that does not react with the cryogen liquid, such as the same material as the first conduit, e.g., aluminum.

The second conduit 26 surrounds the inner and outer coil shells 12, 14 and, in one embodiment, surrounds the first layer 24 of thermal insulation, thereby further separating the space 18 from the external environment. As shown in FIG. 4, the second conduit 26 may be a closed system with the second cryogenic fluid within the conduit, but with no inputs or outputs that are functional during operation other than that required for venting of boil-off gasses. Alternatively, as shown in FIG. 5, the radiation shield device 10 may include a second storage tank 30 that stores the second cryogenic liquid, such as liquid hydrogen. The second storage tank 30 may be in fluid communication with the second conduit 26 so as to at least partially fill and, in one embodiment, completely fill the second conduit, both initially and as the second cryogenic liquid boils off during operation. The radiation shield device of one embodiment could include a pump or other device for moving the first cryogenic liquid from the second storage tank to the second conduit. However, the radiation shield device may be configured such that the second cryogenic liquid self-disperses or self-dissipates within the second conduit in a 0 G environment. Additionally, the radiation shield device may be configured such that while the space vehicle is on the ground, the second cryogenic liquid flows from the second storage tank to the second conduit as a result of a gravity feed. Additionally, the radiation shield device 10 may include thermal insulation 32 that at least partially surrounds the second storage tank 30 so as to further thermally isolate the second storage tank. The thermal insulation 32 that surrounds the second storage tank 30 may be the same as or different than the thermal insulation 22 that surrounds the first storage tank 20 and/or the first layer 24 of thermal insulation described above. Although the thermal insulation 32 may be formed of various materials, the thermal insulation of one embodiment is formed of a layered composite insulation with paper.

The first and second conduits may include predefined inlets and outlets for controllably introducing and removing cryogen liquids, such as the inlets and outlets fluidly connecting the first and second conduits with the first and second storage tanks 20, 30, respectively. However, the first and second conduits are otherwise watertight such that a cryogen liquid circulated through a respective conduit remains within the respective conduit and does not leak out, except for venting of boil-off gasses.

As shown in FIGS. 4 and 5, the radiation shield device 10 may also include a second layer 28 of thermal insulation that extends about the second conduit 28 and, in one embodiment, surrounds the second conduit. The second layer 28 of thermal insulation that surrounds the second conduit 28 may be the same as or different than the other layers of thermal insulation described above. Although the second layer 28 of thermal insulation may be formed of various materials, the thermal insulation of one embodiment is formed of a layered composite insulation with paper.

By positioning the first and/or second storage tanks 20, 30 for the first and second cryogenic liquids within the space 18 between the first and second coil shells 12, 14, the limited space upon the spacecraft is advantageously conserved by making use of an otherwise unused region and avoiding placement of the first and/or second storage tanks within the crew compartment or other area 16 that is protected from radiation. Also, by positioning the first and/or storage tanks 20, 30 between the first and second coil shells 12, 14 in the space 18, the first and/or second storage tanks are within one or more layers of thermal insulation so as to thermally isolate the first and/or second storage tanks and, more particularly, the first and/or second cryogenic liquids.

As shown in FIG. 6, the operations performed in accordance with one embodiment of the present disclosure for cryogenically cooling the coils of the first and second coil shells 12, 14 are shown. As shown in operation 40, the second conduit 26 that at least partially surrounds the inner and outer coil shells 12, 14 is also at least partially filled with a second cryogenic liquid, different than the first cryogenic liquid. As described above and in conjunction with the embodiment of FIG. 5, at least some of the second cryogenic liquid may be stored in a second storage tank 30 disposed between the inner and outer coil shells 12, 14. See, for example, optional operation 42 of FIG. 6. The second storage tank 30 is in fluid communication with the second conduit 26 of the inner and outer coil shells 12, 14 such that first cryogenic liquid may be supplied from the second storage tank to the second conduit in order to initially fill the second conduit as well as to thereafter refill the second conduit as a portion of the second cryogenic liquid boils off.

As shown in operation 44 of FIG. 6, the inner and outer coil shells 12, 14 are also at least partially immersed and, in one embodiment, fully immersed within a first cryogenic liquid, such as liquid helium, such as by filling the respective first conduits with the first cryogenic liquid. As described above and as shown in FIGS. 4 and 5, at least some of the first cryogenic liquid may also be stored in a first storage tank 20 that is disposed between the inner and outer coil shells 12, 14. See, for example, operation 42 of FIG. 6. The first storage tank 20 is in fluid communication with the respective conduits of the inner and outer coil shells 12, 14 such that first cryogenic liquid may be supplied from the first storage tank to the respective first conduits in order to initially fill the respective first conduits as well as to thereafter refill the respective conduits as a portion of the first cryogenic liquid boils off.

Although the first and second cryogenic liquids may be introduced into the first and second conduits, respectively, at the same time or in any order, the second cryogenic liquid is introduced into the second conduit 26 prior to the introduction of the first cryogenic liquid into the respective first conduits in order to promote efficient operation. In this regard, the second cryogenic liquid which may have a larger latent heat than the first cryogenic liquid and which may therefore absorb heat in a more efficient and rapid manner may perform the bulk of the cooling which can lower the temperature of the radiation shield device 10 by a substantial amount, such as to the boiling point of the second cryogenic liquid, even though the second cryogenic liquid may not be able to completely lower the temperature to the desired temperature for superconducting operations. Once the second cryogenic liquid has lowered the temperature a substantial amount, such as to or near the boiling point of the second cryogenic liquid, such as −253° C. in one embodiment, the first cryogenic liquid may be circulated through the respective first conduits in order to further reduce the temperature of the coils to a temperature sufficient for superconducting operations, such as to −269° C. in an instance in which the first cryogenic liquid is liquid helium. This efficient multi-stage cooling of the coils to the desired temperature for superconducting operations also permits the coils to be cooled in a manner that requires less coolant in terms of weight and/or volume, thereby reducing the quantity of coolant that the space vehicle, for example, must transport. Although the timing of the introduction and circulation of the first and second cryogenic liquids may be accomplished in various manners, the radiation shield device 10 may include a controller for controlling valves and other flow control devices in order to appropriately introduce the cryogenic liquids into the respective conduits.

Once the temperature of the coils has been lowered so as to support superconducting operation, current may be provided to the coils by a power source as shown in operation 48 with the direction of the current through the coils being controlled as described above. Based upon the flow of current through the coils and the direction of the current flow, a protective magnetic field may be generated about the space vehicle. See operation 50 of FIG. 6. In order to maintain the coils at a temperature that is sufficiently low to support superconducting operations, the first and second cryogenic liquids may continue to be circulated with the boil-off of the first cryogenic liquid serving to overcome the internal heat or the heat transported in the first cryogenic liquid through the first layer of thermal insulation 24 external to the respective first conduits, while the boil-off of the second cryogenic liquid serves to overcome the heat absorbed from the ambient atmosphere through the second layer 28 of thermal insulation.

As such, the area 16, such as a space vehicle, may be shielded from radiation utilizing coils formed of a superconductive material that are efficiently cooled in a manner that limits the quantity of coolant that is required. While the method of shielding an area 16 from radiation may be activated in response to detection of approaching particle radiation, but may otherwise be deactuated in instances in which particle radiation is not imminent, the method of one embodiment is continuously activated so as to continuously shield the area from radiation. In this regard, the radiation shield device 10 and associated method of embodiments of the present disclosure thermally isolate the coils as well as the cryogenic liquids, both with the layers of thermal insulation and with the placement of the storage tanks within the space 18 between the inner and outer coil shells 12, 14 so as to limit the boil off of the cryogenic liquids which, in turn, permits the radiation shield device to be operated in a continuous manner. By operating continuously, the radiation shield device 10 may improve the mission readiness and availability. In one embodiment, however, the radiation shield device may be continuously operated with the second conduit 26 filled with the second cryogenic liquid, but without circulation of the first cryogenic liquid through the respective first conduits and without enerigization of the coils such that the coils are maintained at a temperature near, e.g., −253° C., but not at the critical superconducting temperature onset level. Once approaching particle radiation is detected, the first conduits may be filled with the first cryogenic liquid so as to lower the temperature of the coils to the critical superconducting temperature onset level and the coils may then be energized. As such, the time required for the radiation shield device to become active is reduced while avoiding unnecessary full mission liquid helium cryogen usage or power application inefficiencies otherwise created by having the coils maintained at their full superconducting temperature or energized at all times.

Many modifications and other embodiments of the present disclosure set forth herein will come to mind to one skilled in the art to which these embodiments pertain having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A radiation shield device having embedded cryogen storage, the radiation shield device comprising:

at least two coil shells comprised of a superconductive material and disposed within respective first conduits filled with a first cryogen liquid, wherein the at least two coil shells extend about an area to be shielded from radiation;

at least one storage shell defining a second conduit filled with a second cryogen liquid that is different than the first cryogen liquid, wherein the at least one storage shell is disposed about an exterior of the at least two coil shells; and thermal insulation surrounding the first conduits and positioned between the first conduits and the at least one second conduit, wherein the thermal insulation couples the second conduit and the at least two coil shells.

2. A radiation shield device of claim 1 further comprising a first storage tank configured to store the first cryogen liquid and disposed in fluid communication with the first conduits.

3. A radiation shield device of claim 2 wherein the first storage tank is disposed between the at least two coil shells.

4. A radiation shield device of claim 1 further comprising a second storage tank configured to store the second cryogen liquid and disposed in fluid communication with the at least one storage shell.

5. A radiation shield device of claim 4 wherein the second storage tank is disposed between the at least two coil shells.

6. A radiation shield device of claim 1 further comprising thermal insulation surrounding the second conduit and positioned between the second conduit filled with the second cryogen liquid and an external ambient thermal environment.

7. A radiation shield device comprising:

inner and outer coil shells that extend about an area to be shielded from radiation, each coil shell comprising coils formed of a superconductive material and disposed within respective first conduits;

a first storage tank configured to store a first cryogen liquid and disposed in fluid communication with the first conduits, wherein the first storage tank is disposed between the inner and outer coil shells;

a second conduit at least partially surrounding the inner and outer coil shells, wherein the second conduit is configured to be at least partially filled with a second cryogen liquid, different than the first cryogen liquid; and thermal insulation disposed between the first and second conduits.

8. A radiation shield device of claim 7 further comprising a second storage tank configured to store the second cryogen liquid and disposed in fluid communication with the second conduit.

9. A radiation shield device of claim 8 wherein the second storage tank is disposed between the inner and outer coil shells.

10. A radiation shield device of claim 7 further comprising thermal insulation surrounding the first storage tank.

11. A radiation shield device of claim 7 further comprising thermal insulation surrounding the second conduit and positioned between the second conduit filled with the second cryogen liquid and an external ambient thermal environment.

12. A radiation shield device of claim 7 wherein the thermal insulation disposed between the first and second conduits surrounds both the inner and outer coil shells.

13. A radiation shield device of claim 7 wherein the second conduit surrounds both the inner and outer coil shells.

14. A method of cryogenically cooling a radiation shield device, the method comprising:

at least partially immersing coils of inner and outer coil shells within a first cryogen liquid, wherein the coils of the inner and outer coil shells are formed of a superconductive material and extend about an area to be shielded from radiation;

storing at least some of the first cryogen liquid in a first storage tank, wherein the first storage tank is disposed between the inner and outer coil shells and is in fluid communication with the inner and outer coil shells; and at least partially filling a second conduit with a second cryogen liquid that is different than the first cryogen liquid, wherein the second conduit at least partially surrounds the inner and outer coil shells and is separated from the inner and outer coil shells by thermal insulation disposed therebetween.

15. A method of claim 14 wherein at least partially immersing the inner and outer coil shells comprises at least partially filling respective first conduits in which the inner and outer coil shells are disposed with the first cryogen liquid.

16. A method of claim 14 further comprising storing at least some of the second cryogen liquid in a second storage tank that is in fluid communication with the second conduit.

17. A method of claim 14 wherein storing at least some of the second cryogen liquid in a second storage tank comprises storing at least some of the second cryogen liquid in a second storage tank that is disposed between the inner and outer coil shells.

18. A method of claim 14 further comprising at least partially surrounding the first storage tank with thermal insulation.

19. A method of claim 14 further comprising at least partially surrounding the second conduit with thermal insulation.

* * * * *